US007621649B2

(12) United States Patent
Oyama

(10) Patent No.: US 7,621,649 B2
(45) Date of Patent: Nov. 24, 2009

(54) LIGHT DISTRIBUTION CONTROL TYPE ILLUMINATOR

(75) Inventor: Nobuo Oyama, Tokyo (JP)

(73) Assignee: Kabushiki Kaisha S.T.I. Japan, Tokyo (JP)

( * ) Notice: Subject to any disclaimer, the term of this patent is extended or adjusted under 35 U.S.C. 154(b) by 270 days.

(21) Appl. No.: 10/574,076

(22) PCT Filed: Sep. 22, 2004

(86) PCT No.: PCT/JP2004/013818

§ 371 (c)(1),
(2), (4) Date: Sep. 21, 2006

(87) PCT Pub. No.: WO2005/033578

PCT Pub. Date: Apr. 14, 2005

(65) Prior Publication Data

US 2007/0195530 A1 Aug. 23, 2007

(30) Foreign Application Priority Data

Sep. 30, 2003 (JP) ..... 2003-339476

(51) Int. Cl.
*F21V 21/30* (2006.01)
*F21V 7/00* (2006.01)
*F21V 21/26* (2006.01)

(52) U.S. Cl. ..... 362/35; 362/213; 362/263; 362/269; 362/300; 362/297; 353/31

(58) Field of Classification Search ..... 362/19, 362/35, 211, 213, 262, 263, 269, 275, 296, 362/300, 310; 353/31
See application file for complete search history.

(56) References Cited

U.S. PATENT DOCUMENTS 5,662,400 A * 9/1997 Shikama et al. ..... 353/31
6,183,120 B1 2/2001 Simon
6,464,376 B1 10/2002 Willson

FOREIGN PATENT DOCUMENTS

| | | | |
|---|---|---|---|
| EP | 0 459 786 | | 12/1991 |
| EP | 0 643 257 | | 3/1995 |
| JP | 57-175309 | | 11/1982 |
| JP | 5-101702 | | 4/1993 |
| JP | 11-111005 | * | 4/1999 |
| JP | 11-111006 | | 4/1999 |
| JP | 2002-93203 | | 3/2002 |
| JP | 2002-216518 | | 8/2002 |
| JP | 2002-237204 | | 8/2002 |
| WO | 2004/085919 | | 10/2004 |

* cited by examiner

*Primary Examiner*—Jacob Y Choi
(74) *Attorney, Agent, or Firm*—Wenderoth, Lind & Ponack, L.L.P.

(57) ABSTRACT

A light distribution controller for discharge lamps having improved lamp efficiency while maintaining a specific lighting posture. The controller includes a lighting source (1) in which electric discharge is caused between opposed electrodes (2, 4) to radiate light, a reflecting mirror (5) for reflecting a flux of light radiated from the light source (1) to control the light flux angle, and travel path changing mirror (7) for changing the travel path of the flux of light whose divergence is controlled by the reflecting mirror (5). The light source (1) is arranged such that the axial line connecting the electrodes (2, 4) of the light source (1) or a reference line used for another posture specification is substantially aligned with the center line of the flux of light controlled by the reflecting mirror (5). The path changing mirror (7) can change the direction in which the controlled flux of light travels to a desired direction with respect to the center line of the controlled flux of light.

4 Claims, 6 Drawing Sheets

(a)

(b)

(a)

(b)

LIGHT DISTRIBUTION CONTROL TYPE ILLUMINATOR

TECHNICAL FIELD

The present invention relates to a light distribution control type illuminator.

BACKGROUND ART

Metal halide lamps, a type of discharge lamp, are light sources that seal a metal halide in an arc tube together with mercury and rare gas, and heat the metal halide at high temperature through electric discharge between electrodes of the arc tube to thereby separate the metal halide into metal atoms and halogen atoms and discharge electricity mainly composed of a spectrum that is obtained by exciting the metal atoms. Metal halide lamps have a well-balanced visible radiation spectrum distribution, which gives them excellent color rendering properties, and are fit for many illumination uses.

A certain type of metal halide for metal halide lamps partially remains in a liquid state in the coldest spot of the arc tube while the lamp is lit. The temperature of the coldest spot is therefore changed by changing the posture in which the lamp is lit, and the vapor pressure of the metal halide is accordingly changed as well as the lamp voltage and temperature and light color. Similar changes in characteristics occur for metal halides that are completely evaporated while the lamp is lit since the density distribution in the arc tube changes in accordance with the posture of the lit lamp. This is why a lighting posture in which the optimum characteristics are obtained is specified for metal halide lamps. Low pressure sodium lamps, which have extremely high visible light emission efficiency, possess similar characteristics and therefore take a designated posture when lit (see, for example, Non-patent Document 1).

Various "light flux angle control mirrors" such as condenser mirrors control the divergence of a flux of light emitted from a light source by reflecting. The positional relation between a light flux angle control mirror and a point light source is such that an ideal center line of a flux of light emitted from the point light source and controlled by the mirror runs through the point light source along a sole axis, which is called a "light flux angle control mirror axis".

Some of those discharge lamps for which a lighting posture is specified are used as illuminators placed in front of a "light flux angle control mirror" to send a flux of light forward beyond the mirror. For many of metal halide lamps and low pressure sodium lamps that are used in this way, the tilt of a "lamp axis", namely, the line connecting the electrodes of the lamp, with respect to the vertical or horizontal direction is set to a given specified range.

A specific example of a lamp whose tilt with respect to the horizontal direction is set to a given specified range is shown in FIG. 5. A line 54 (lamp axis) connecting electrodes 51 and 53 of a lamp 50 to each other coincides with a lamp length axis 56, and an angle within $\pm\alpha°$ from the horizontal line serving as the reference is specified for a lighting posture of the lamp 50.

When a lamp for which a lighting posture is specified and a light flux angle control mirror are arranged limiting the tilt of the "lamp axis" with respect to the vertical direction, the "lamp axis" is set such that the "lamp axis" and the "light flux angle control mirror axis" are orthogonal to each other or substantially coincide with each other. In the former case, the tilt of the center axis of a controlled flux of light is limited with respect to the horizontal direction the same way the tilt of the "lamp axis" is limited with respect to the vertical direction. In the latter case, the same limitation is placed on the tilt of the center axis of a controlled flux of light and the tilt of the "lamp axis".

When the tilt of the "lamp axis" is limited with respect to the horizontal direction, the "lamp axis" is set such that the "lamp axis" and the "light flux angle control mirror axis" are orthogonal to each other or substantially coincide with each other. In the former case, the center axis of a controlled flux of light is not limited in the up-and-down direction as long as the illuminator is installed in a manner that meets the limitation placed on the "lamp axis" with respect to the horizontal direction. In the latter case, the center axis of a controlled flux of light is limited in the up-and-down direction the same way the "lamp axis" is limited. Non-patent Document 1: "Illumination Handbook", Ohmsha. Ltd., Jul. 30, 1985 (First Edition, Fifth Printing), p. 179-181

SUMMARY OF THE INVENTION

A flux of light from a discharge lamp is radiated in a circumferential direction of the lamp axis as shown in FIGS. 6(*a*) and 6(*b*). The density of the flux of light increases toward a plane that is orthogonal to the axis, and almost no flux of light is radiated in the axial direction.

Therefore, in an example shown in FIG. 7 where the tilt of a "lamp axis" of a lamp 50 is limited with respect to the horizontal direction, the lamp axis 56 is set to be orthogonal to an "axis 57 of a light flux angle control mirror 55", and the illuminator is installed in a manner that meets the limitation placed on the "lamp axis" with respect to the horizontal direction to obtain freedom in the up-and-down direction for the light flux center axis (according to this method, rotating the illuminator about the lamp axis 56, or about an axis 59 parallel to the lamp axis 56, or about a vertical axis does not change the posture of the lamp and the direction of the light flux center line can be changed freely as shown in FIG. 7), only a portion of a flux of light radiated to the left hand side in FIG. 8(*a*) is caught whereas most of the flux of light passes by the mirror. In order for the "light flux angle control mirror" to catch more of a flux of light from this discharge lamp and to forward the light beyond the mirror, it is desirable to make the "lamp axis" substantially coincide with the "light flux angle control mirror axis" as shown in FIG. 8(*b*). In this case, however, redirecting a light flux center line in the up-and-down direction causes the lamp to exceed its specified posture range, and results in sacrificing the best characteristics of the lamp.

In short, an illuminator whose lamp and light flux angle control mirror such as a condenser mirror have a positional relation like this sacrifices the best characteristics when radiating a flux of light in a direction that causes the lamp to exceed a specified posture range, and this needs to be solved.

The present invention has been made to solve this problem, and therefore provides an illuminator that can catch and control more of a flux of light while being capable of redirecting a light flux center line in all directions without changing the posture of the lamp.

(1) A light distribution control type illuminator according to the present invention includes: a light source for radiating light through electric discharge between opposing electrodes; a reflecting mirror for reflecting a flux of light that is radiated from the light source in order to control the angle of the flux of light; and a path changing mirror for changing the path of the flux of light whose divergence has been controlled by the reflecting mirror, in which the light source is placed in a manner that makes an axis line connecting the electrodes of the light source, or other reference lines used to specify a posture, substantially coincide with a center line of the flux of light controlled by the reflecting mirror, while the path changing mirror can redirect the controlled flux of light to a desired direction around the center line of the controlled flux of light.

(2) The light distribution control type illuminator further includes a casing for housing the light source and the reflecting mirror which controls the angle of a flux of light emitted from the light source; and a path changing mirror container set on a controlled light flux path side of the casing to house the path changing mirror, in which the path changing mirror container is attached to the casing in a manner that allows the path changing mirror container to rotate about a travel direction axis line of the controlled flux of light.

(3) The light distribution control type illuminator further includes a holding means provided to hold the casing such that the casing can be positioned in a desired direction around a vertical axis line.

(4) The light distribution control type illuminator is characterized in that the light source is a discharge lamp such as a metal halide lamp or a low pressure sodium lamp.

(5) The path changing mirror of the above items (1) to (4) is replaced with a light reflector shaped like a flat plate or a curved plate and having, on at least one side, ridges that are shaped like an arc, an elliptical arc, or a sine curve in section and that are arranged side by side in contact with one another, the light reflector having on its reflecting face a transparent body portion that is composed of the ridges, or the path changing mirror is replaced with a flat or curved structure in which surfaces of the ridges have a light reflecting function.

Effect of the Invention (1) A light distribution control device according to the present invention, in which a light source is arranged in a manner that makes an axis line connecting electrodes of the light source, or other reference lines used to specify a posture, substantially coincide with a center line of a flux of light controlled by a reflecting mirror, and in which a path changing mirror is provided to change the path of the controlled flux of light to a desired direction around a travel direction axis line of the controlled flux of light, is capable of emitting the controlled flux of light in a desired direction while keeping the posture of the light source in the direction of the axis line that connects the electrodes of the light source. As a result, more of a flux of light can be caught, and at the same time, the center line of the flux of light can be directed in all directions without changing the posture of the light source.

(2) The light distribution control type illuminator further includes: a casing for housing the light source and the reflecting mirror; and a path changing mirror container set on a controlled light flux path side of the casing to house the path changing mirror, in which the path changing mirror container is attached to the casing in a manner that allows the path changing mirror container to rotate about a travel direction axis line of the controlled flux of light. As a result, in addition to the effect of the above item (1), the entirety of the device can be made compact.

(3) Provided with a holding means for holding the casing such that the casing can be positioned in a desired direction around a vertical axis line, the device can emit a flux of light in a desired direction while keeping the light source in a specified lighting posture through a combination of a direction in which the casing is attached and a position at which the holding member is rotated.

(4) When a posture in which the light source is lit is specified as in many metal halide lamps, low pressure sodium lamps and the like, the device can catch more of a flux of light and at the same time can direct the center line of the flux of light in all directions without changing the posture of the light source. In other words, the lamp can be enhanced in efficiency while exerting its color rendering effect without changing lamp characteristics.

(5) The path changing mirror of the above items (1) to (4) is replaced with a light reflector shaped like a flat plate or a curved plate and having, on at least one side, ridges that are shaped like an arc, an elliptical arc, or a sine curve in section and that are arranged side by side in contact with one another, the light reflector having on its reflecting face a transparent body portion that is composed of the ridges, or the path changing mirror is replaced with a flat or curved structure in which surfaces of the ridges have a light reflecting function. The device can thus control the path of substantially all components of a flux of light radiated from a light source 1, and is capable of uniform light distribution throughout a wide range, which improves the color rendering effect even more.

DETAILED DESCRIPTION OF THE INVENTION

Figure 1:
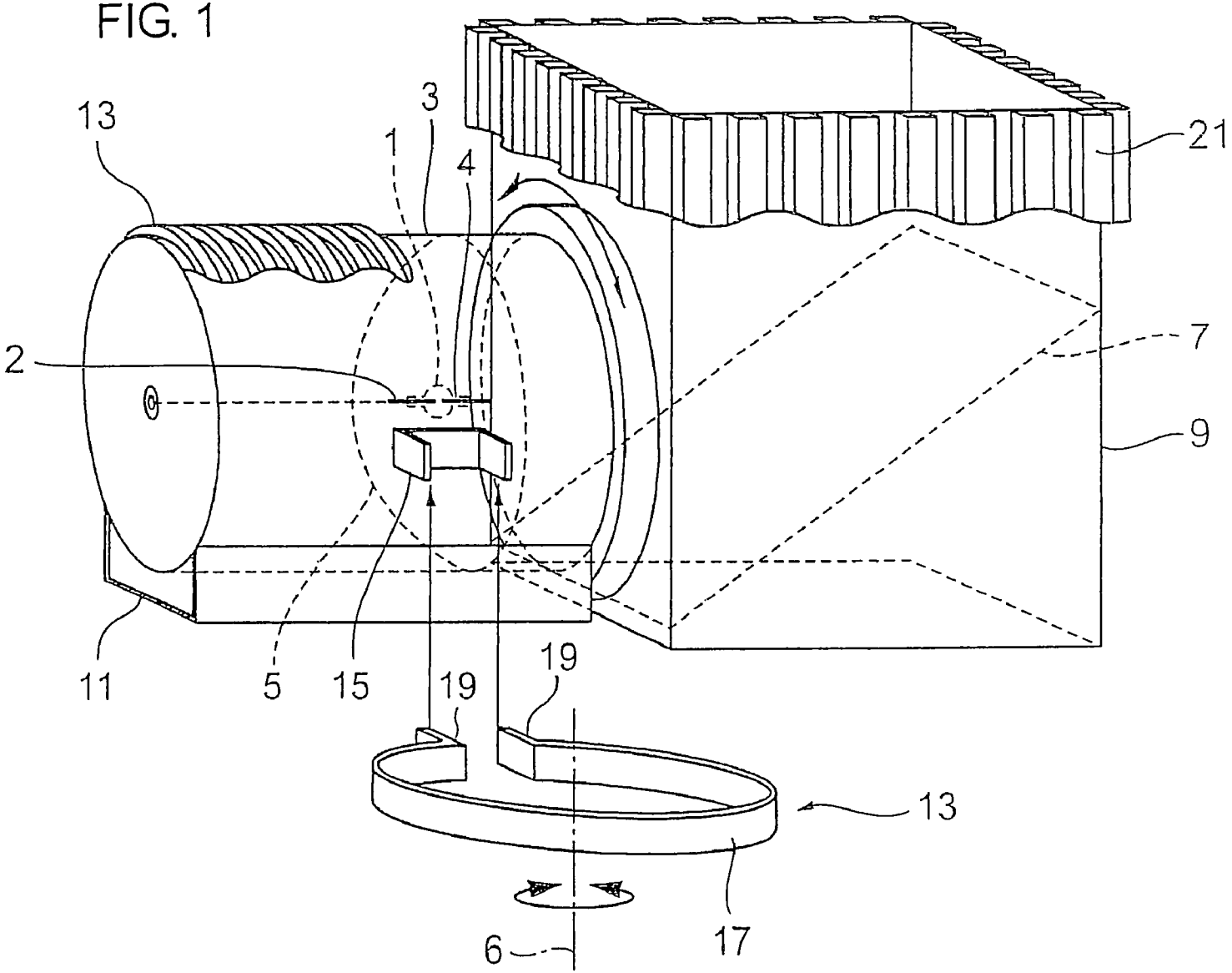
FIG. 1 is an explanatory diagram of the configuration of a light distribution control device according to an embodiment of the present invention.

FIG. 1 is an explanatory diagram of a light distribution control device according to an embodiment of the present invention. The light distribution control device according to this embodiment has, as shown in FIG. 1, a light source 1 for radiating light through electric discharge between opposing electrodes 2 and 4, a casing 3 which houses the light source 1, a reflecting mirror 5 disposed behind the light source 1 inside the casing 3 to reflect a flux of light radiated from the light source 1 and thereby control the angle of the flux of light, a path changing mirror 7 placed in front of the casing 3 to change the path of the flux of light controlled by the reflecting mirror 5, and a path changing mirror container 9 which houses the path changing mirror 7 to keep the path changing mirror 7 in a given posture.

The components are described in more detail below.

Figure 5:
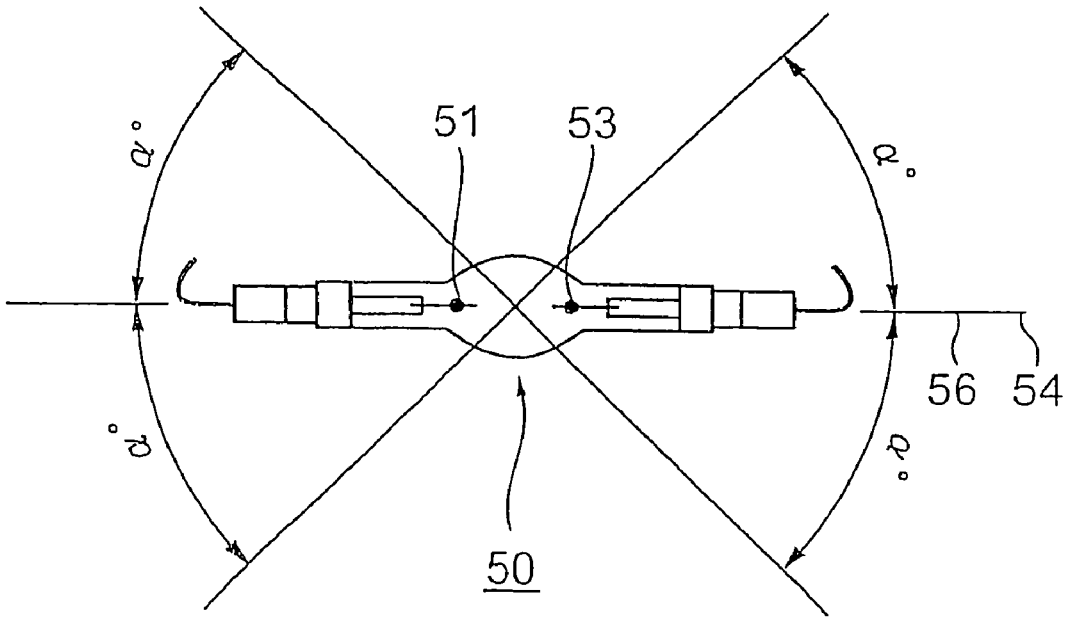
FIG. 5 is an explanatory diagram of a metal halide lamp.
Figure 6:
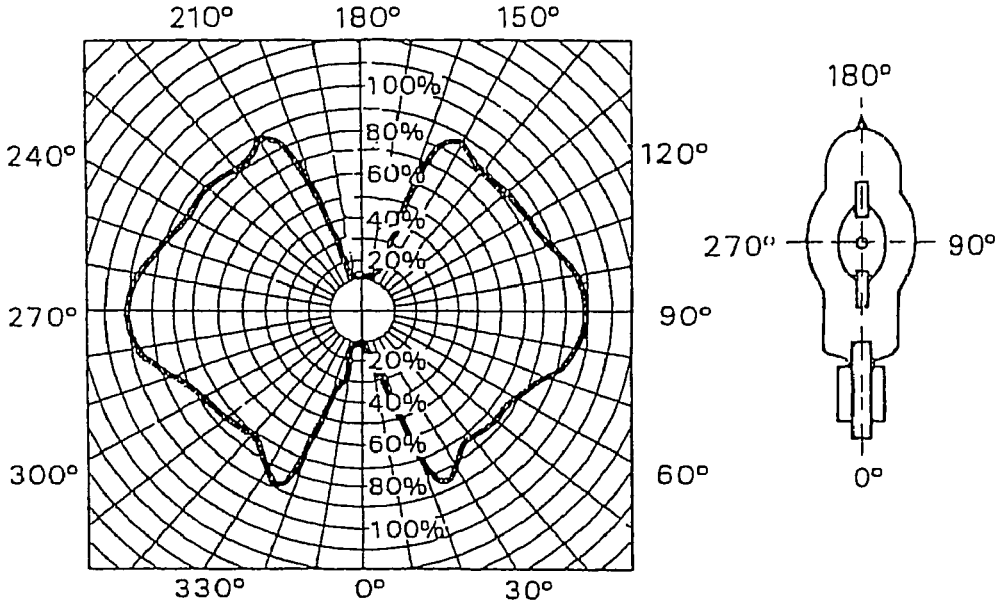
FIG. 6 is an explanatory diagram about how light from the metal halide lamp is distributed.
Figure 6:
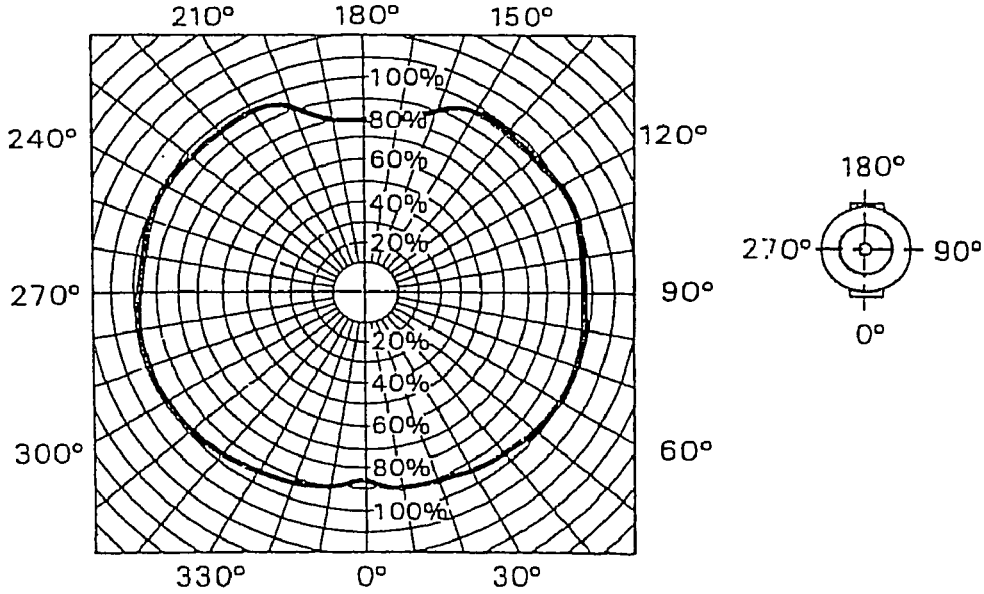
Figure 7:
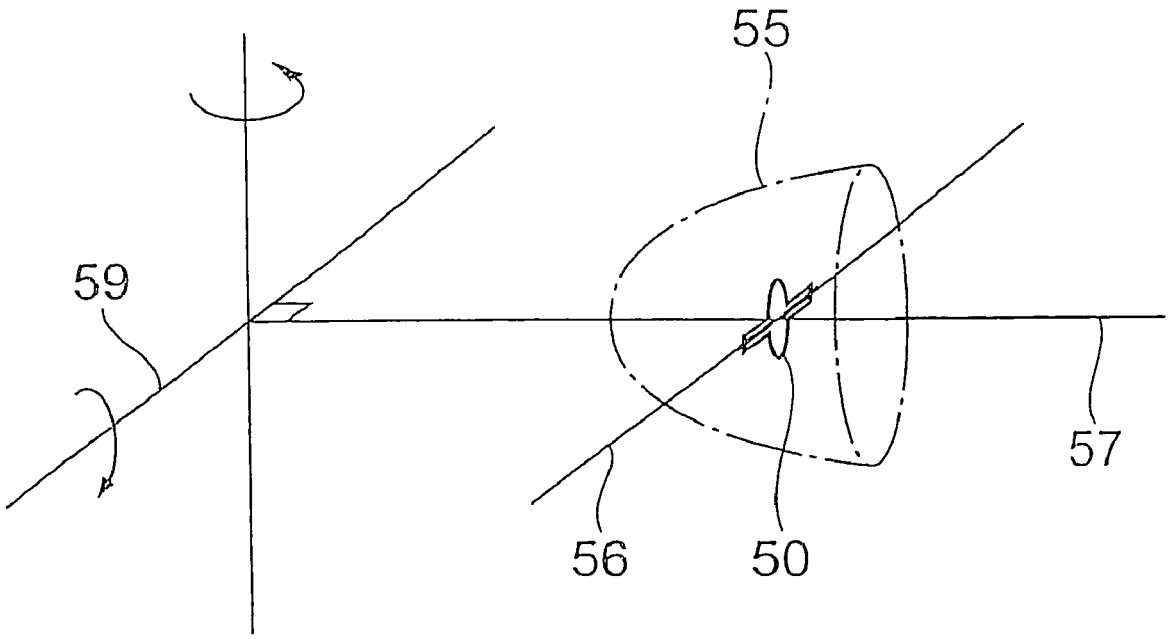
FIG. 7 is an explanatory diagram of a problem to be solved by the present invention (part 1).

Employed as the light source 1 is a lamp for which a lighting posture is specified such as a metal halide lamp shown in FIG. 5 or a low pressure sodium lamp. The specified lighting posture is a posture specified, by a lamp maker or the like, for the lamp to take when lit in order to obtain the best possible characteristics of the lamp. A lamp posture is specified with the use of the "lamp axis", or other reference lines of the lamp in some cases. In this case, a reference line that is employed replaces the "lamp axis".

The casing 3 comprises a cylindrical body including an electronic parts housing portion 11 for storing electronic parts for lighting the light source 1. Almost the entire outer surface of the casing 3 is covered with ridges 13 for enhancing the heat dissipation effect. Only a part of the ridges 13 is shown in FIG. 1 to avoid complicating the drawing.

As shown in FIG. 1, the casing 3 may have on one side face thereof a holding means 13 for holding the casing 3 such that the casing 3 can be positioned in a desired direction around a vertical axis line 6. The holding means 13 comprises a support member 15 which is fixed to the casing 3 side and which is shaped like the letter C in section, and a ring-like member 17 with an opening. Protruding pieces 19, which are placed at the opening of the ring-like member 17 to protrude outward away from the ring, are fixed to the arms of the support member 15 with a screw. The light distribution control device is installed by fixing the holding means 13 to a rod member or the like which is provided on the stationary side such as a building. The rod member or the like is inserted within the ring of the ring-like member 17 and adjusted in a given direction. Then the screw is fastened to constrict the rod member with the ring-like member 17. Thus the light distribution control device can be fixed in a desired direction around a vertical axis line while keeping the light source 1 in a specified posture.

The reflecting mirror 5 is composed of a spheroid mirror having a light collecting function, and is set within the casing 1 with its reflecting face facing the path changing mirror 7. The light source is set within the reflecting mirror 5 in a manner that makes a line connecting the electrodes of the light source, namely, the "lamp axis", substantially coincide with the axis of the reflecting mirror 5, namely, the "light flux angle control mirror axis". The shape of the reflecting face of the reflecting mirror 5 is not limited to a spheroidal shape, but may be a hemispherical shape, a paraboloidal shape, or other shapes.

The path changing mirror 7 set in the path changing mirror container 9 is tilted at an angle of, typically, 45° with respect to the axis line connecting the electrodes of the light source 1. The path changing mirror 7, which, in this example, is a plane mirror with a planar reflecting face, may be a curved mirror with a curved reflecting face.

The path changing mirror container 9 is made from a rectangular box opened at one end, and holds the path changing mirror 7 such that the reflecting face of the path changing mirror 7 faces the opened end. One side face of the path changing mirror container 9 is attached to one end of the casing 3 in a rotatable manner. By rotating the path changing mirror container 9, the optical path changing mirror 7 can be redirected in a desired direction around the axis line of a controlled flux of light.

Almost the entire surface of the path changing mirror container 9 is covered with heat dissipating ridges 21 as is the surface of the casing 3. Only a part of the ridges 21 is shown in FIG. 1, and the ridges 21 are provided for the same reason described above for the ridges 13 of the casing 3.

Figure 2:
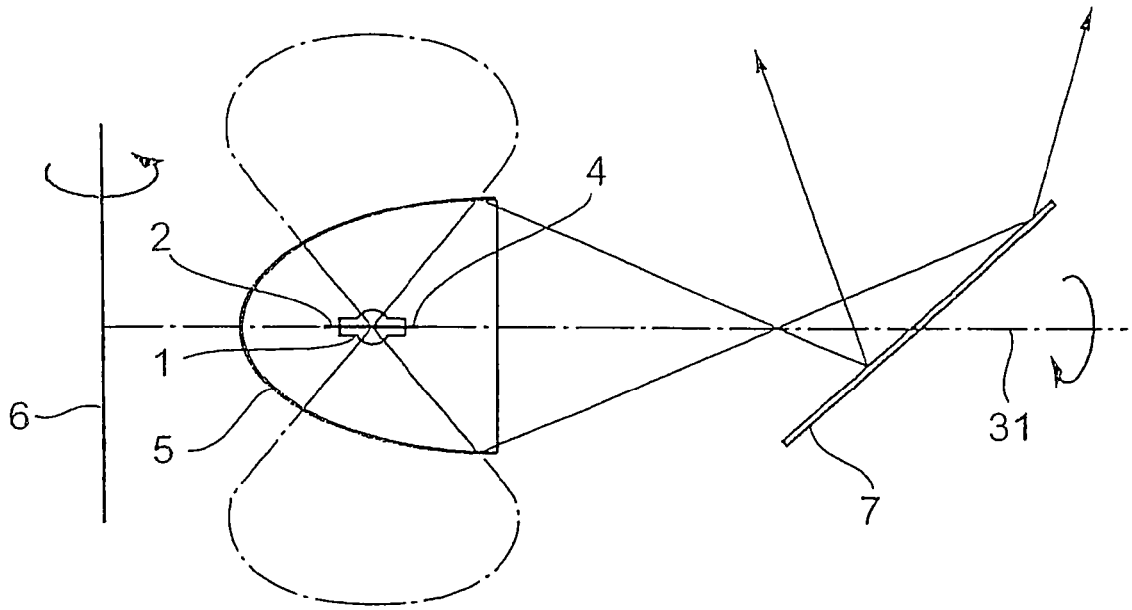
FIG. 2 is an explanatory diagram of the operation of the light distribution control device shown in FIG. 1.
Figure 8:
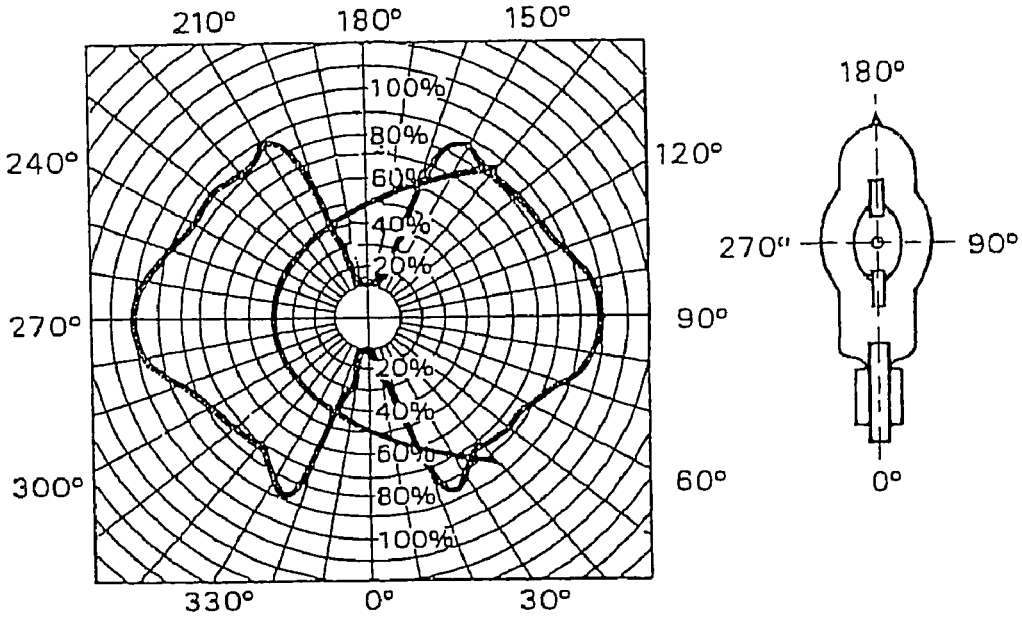
FIG. 8 is an explanatory diagram of a problem to be solved by the present invention (part 2).
Figure 8:
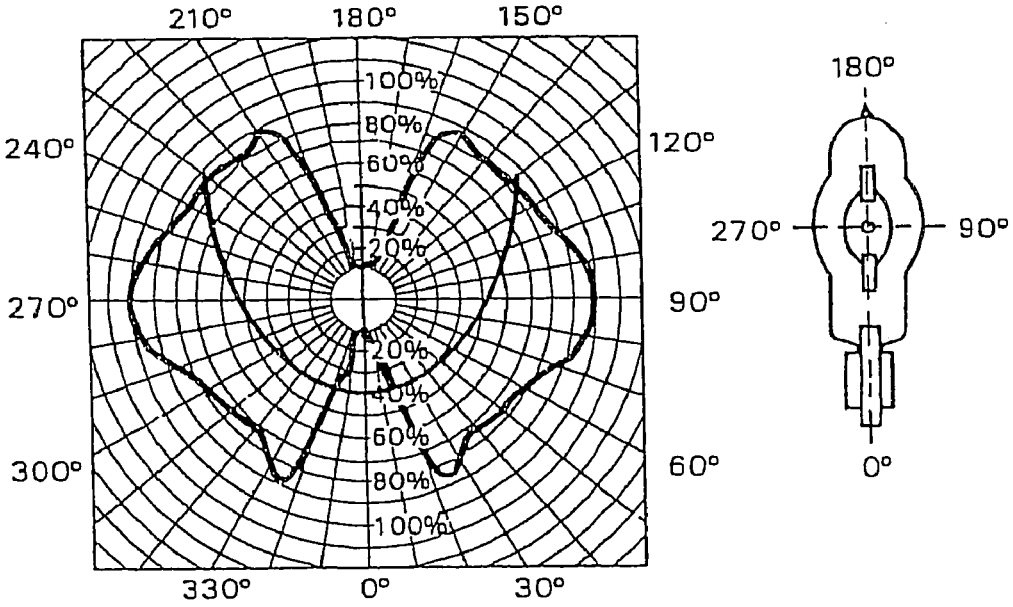

FIG. 2 is an explanatory diagram of the operation of this embodiment shown in FIG. 1. With reference to FIG. 2 and FIG. 1, the operation of this embodiment is described below. The light source 1 is placed such that the line connecting the electrodes 2 and 4 of the light source 1, namely the "lamp axis", coincides with an axis 31 of a controlled flux of light as shown in FIG. 2. This enables the reflecting mirror 5 to catch almost the whole flux of light radiated from the light source 1, collect the light on the opening side, and reflect the collected light. In short, arranging the light source 1 such that the line connecting the electrodes 2 and 4 of the light source 1 coincides with the axis 31 of the controlled flux of light makes it possible to almost totally control a flux of light radiated from the light source 1. In this regard, the lamp efficiency is greatly improved compared to prior art where only about a half of a flux of light is controlled as shown in FIG. 8(*a*).

After reflected by the reflecting mirror 5, the controlled flux of light is redirected by the path changing mirror 7 and emitted toward the opening of the path changing mirror container 9. Rotating the path changing mirror container 9, which is attached to the casing 3 in a rotatable manner, allows the path changing mirror 7 to rotate about the axis 31 of the controlled flux of light. The path changing mirror 7 can thus emit the controlled flux of light in a desired direction around its axis line.

The direction of the casing 3 housing the reflecting mirror 5 can be adjusted around the vertical axis line 6 while keeping the light source 1 in a specified posture. Therefore, by setting the casing 3 through a direction adjustment around the vertical axis line 6 and rotating the path changing mirror container 9 at the position where the casing 3 is set, almost all components of a flux of light emitted from the light source 1 can be controlled to travel in a desired direction.

In short, according to this embodiment, the path of almost all components of a flux of light emitted from the light source 1 can be controlled while keeping the light source 1 in a specified posture and maintaining a color rendering effect at high level. The lamp efficiency is thus improved by about 30-40% of the conventional example where the controllable quantity of light is sacrificed.

Figure 3:
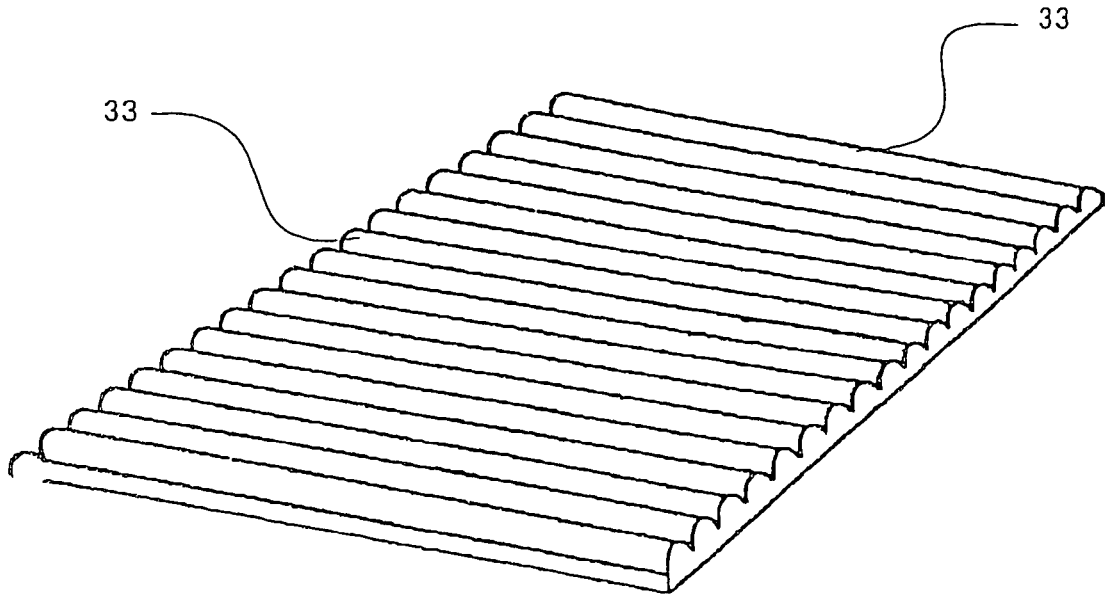
FIG. 3 is an explanatory diagram of a light diffuser used in an embodiment of the present invention (part 1).

A transmissive or reflective light diffuser for diffusing, in a specific direction, a flux of light that is emitted from the path changing mirror 7 may be set at the opening of the path changing mirror container 9. An example of the light diffuser is shown in FIG. 3. Employed in FIG. 3 is a flat transparent body made of resin, glass, quartz or the like and having on at least one side many ridges 33, which are shaped like an arc in section and are arranged in contact with one another. The ridges of the light diffuser may be ones whose cross-sectional shape is like an arc close to a semicircle or an ellipse, ones that are close to a semiellipse or an ellipse in section, or ones shaped like a sine curve in section that is as deep as the above cross-sectional shapes and partially forms a curved edge. It is also possible to use as the light diffuser a laterally aligned body in which many monofilaments are in contact with one another or a transparent body composed of a bundle of monofilaments.

Figure 4:
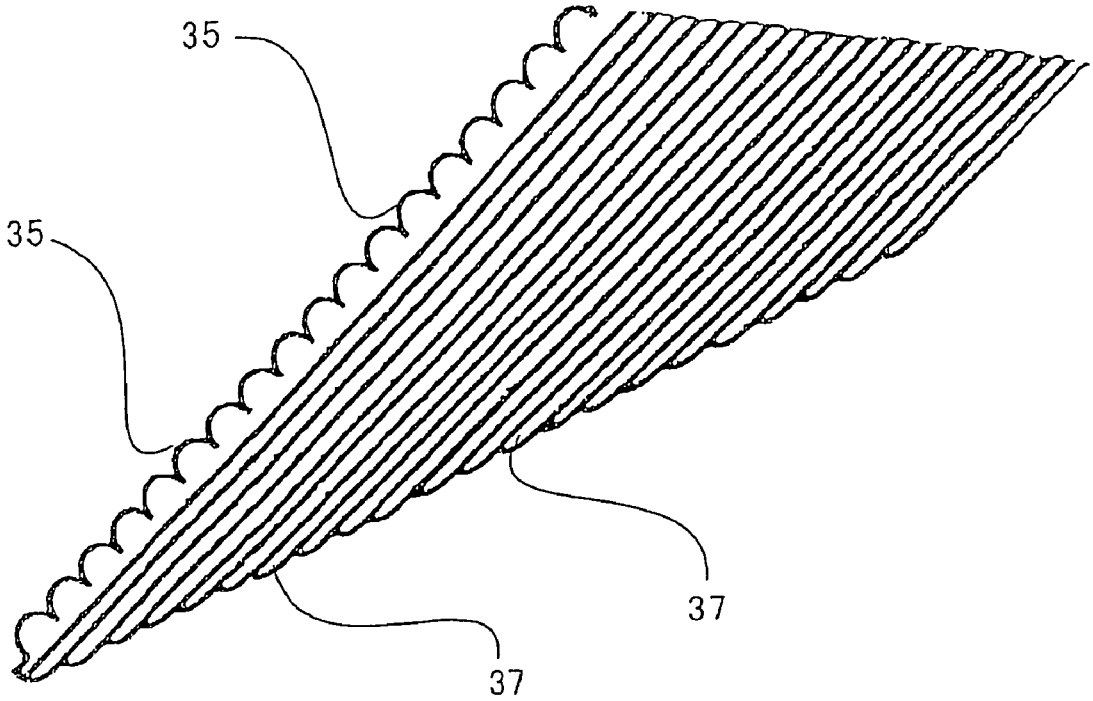
FIG. 4 is an explanatory diagram of a light diffuser used in an embodiment of the present invention (part 2).

This light diffuser can longitudinally and laterally diffuse received light if both sides of the light diffuser have such ridges 35 and 37 as shown in FIG. 4, for example.

If one side of the light diffuser is given a reflecting function to turn the light diffuser into a flat or curved reflector, the light diffuser can double as the path changing mirror 7 and fulfill the light diffusing function and the path changing function both at the same time.

By thus using the light diffuser in combination, the path of substantially all components of a flux of light radiated from the light source 1 can be controlled and light is distributed uniformly throughout a wide range, with the result that the color rendering effect is improved even more.

DESCRIPTION OF SYMBOLS

1 light source
3 casing
5 reflecting mirror
7 path changing mirror
9 path changing mirror container

13 holding means

The invention claimed is:

1. A light distribution control type illuminator, comprising:

a light source for radiating light through electric discharge between opposing electrodes;

a reflecting mirror for reflecting a flux of light that is radiated from the light source in order to control the angle of the flux of light; and a path changing mirror for changing the path of the flux of light whose divergence has been controlled by the reflecting mirror, the light source being placed in a manner that makes an axis line connecting the electrodes of the light source, or other reference lines used to specify a posture of the light source, substantially coincide with a center line of the flux of light controlled by the reflecting mirror, the path changing mirror redirecting the controlled flux of light to a desired direction around the center line of the controlled flux of light;

a casing for housing the light source and the reflecting mirror which controls the angle of a flux of light emitted from the light source;

a path changing mirror container set on a controlled light flux path side of the casing to house the path changing mirror, the path changing mirror container being attached to the casing in a manner that allows the path changing mirror container to rotate about a travel direction axis line of the controlled flux of light; and a holding means for holding the casing in a desired position in relation to a vertical axis line, wherein the path changing mirror is a light reflector shaped like a flat plate or a curved plate and having, on at least one side, ridges that are shaped like an arc, an elliptical arc, or a sine curve in section and that are arranged side by side in contact with one another, the light reflector having a reflecting face and a transparent body portion on the reflecting face, the transparent body portion being composed of the ridges, or a flat or curved structure in which surfaces of the ridges have a light reflecting function.

2. The light distribution control type illuminator according to claim 1 wherein the light source is a metal halide lamp or a low pressure sodium lamp.

3. A light distribution control type illuminator, comprising:

a light source for radiating light through electric discharge between opposing electrodes;

a reflecting mirror for reflecting a flux of light that is radiated from the light source in order to control the angle of the flux of light; and a path changing mirror for changing the path of the flux of light whose divergence has been controlled by the reflecting mirror, the light source being placed in a manner that makes an axis line connecting the electrodes of the light source, or other reference lines used to specify a posture of the light source, substantially coincide with a center line of the flux of light controlled by the reflecting mirror, the path changing mirror redirecting the controlled flux of light to a desired direction around the center line of the controlled flux of light;

a casing for housing the light source and the reflecting mirror which controls the angle of a flux of light emitted from the light source; and a path changing mirror container set on a controlled light flux path side of the casing to house the path changing mirror, the path changing mirror container being attached to the casing in a manner that allows the path changing mirror container to rotate about a travel direction axis line of the controlled flux of light; and wherein the path changing mirror is a light reflector shaped like a flat plate or a curved plate and having, on at least one side, ridges that are shaped like an arc, an elliptical arc, or a sine curve in section and that are arranged side by side in contact with one another, the light reflector having a reflecting face and a transparent body portion on the reflecting face, the transparent body portion being composed of the ridges, or a flat or curved structure in which surfaces of the ridges have a light reflecting function.

4. The light distribution control type illuminator according to claim 3, wherein the light source is a metal halide lamp or a low pressure sodium lamp.

* * * * *